US008215865B2

(12) United States Patent
Adler et al.

(10) Patent No.: US 8,215,865 B2
(45) Date of Patent: Jul. 10, 2012

(54) ANTI-RAM SYSTEM AND METHOD OF INSTALLATION

(75) Inventors: Richard S. Adler, Upland, CA (US); John Crawford, Burbank, CA (US)

(73) Assignee: RSA Protective Technologies, LLC, Upland, CA (US)

( * ) Notice: Subject to any disclaimer, the term of this patent is extended or adjusted under 35 U.S.C. 154(b) by 0 days.

(21) Appl. No.: 12/694,730

(22) Filed: Jan. 27, 2010

(65) Prior Publication Data

US 2010/0166498 A1 Jul. 1, 2010

Related U.S. Application Data

(63) Continuation of application No. 11/191,251, filed on Jul. 26, 2005, now Pat. No. 7,699,558.

(60) Provisional application No. 60/591,018, filed on Jul. 26, 2004, provisional application No. 60/600,955, filed on Aug. 12, 2004, provisional application No. 60/605,959, filed on Aug. 30, 2004, provisional application No. 60/622,385, filed on Oct. 26, 2004, provisional application No. 60/674,965, filed on Apr. 25, 2005, provisional application No. 60/679,547, filed on May 9, 2005.

(51) Int. Cl.
*E01F 13/00* (2006.01)

(52) U.S. Cl. ..... 404/6; 256/13.1

(58) Field of Classification Search ..... 404/6, 9–11; 256/13.1

See application file for complete search history.

(56) References Cited

U.S. PATENT DOCUMENTS

| | | | | | |
|---|---|---|---|---|---|
| 1,203,006 | A | | 10/1916 | Keenan | |
| 1,449,518 | A | * | 3/1923 | Lawson | 256/13.1 |
| 1,969,845 | A | * | 8/1934 | Hick | 256/13.1 |
| 2,958,926 | A | * | 11/1960 | Morison | 29/838 |
| D233,219 | S | | 10/1974 | O'Donnell | |
| 3,856,268 | A | | 12/1974 | Fitch | |
| 3,934,540 | A | * | 1/1976 | Bruner et al. | 116/63 P |
| 4,062,149 | A | | 12/1977 | Collins | 49/49 |
| 4,515,499 | A | | 5/1985 | Furiate | |
| 4,576,508 | A | | 3/1986 | Dickinson | |
| 4,822,207 | A | | 4/1989 | Swahlan | |
| 4,828,424 | A | * | 5/1989 | Crisp, Sr. | 404/6 |

(Continued)

FOREIGN PATENT DOCUMENTS

DE 34 12354 10/1985

(Continued)

OTHER PUBLICATIONS

PCT International Preliminary Report on Patentability, Apr. 3, 2007, 5 pgs.

(Continued)

*Primary Examiner* — Raymond W Addie

(74) *Attorney, Agent, or Firm* — Frank J. DeRosa; Frommer Lawrence & Haug LLP

(57) ABSTRACT

An anti-ram system and method of construction having a shallow mounted base pad from which extend a plurality of bollards. Very little or only a shallow excavation is required for the base of the bollard system, which can be partially or fully assembled prior to bringing it to the installation site. The shallow mounting pad or base of the bollard system of this invention may be formed or constructed in various ways and of various materials, and in various configurations. The shallow mounting pad or base is constructed so as to have considerable mass.

35 Claims, 17 Drawing Sheets

U.S. PATENT DOCUMENTS

| | | | | |
|---|---|---|---|---|
| 4,934,097 | A | 6/1990 | Quante | 49/49 |
| 5,006,008 | A | 4/1991 | Bishop | |
| 5,201,599 | A | 4/1993 | Kulp et al. | |
| 5,354,037 | A | 10/1994 | Venegas, Jr. | |
| 5,860,762 | A | 1/1999 | Nelson | |
| 5,961,249 | A | 10/1999 | Hansen et al. | 404/9 |
| 6,219,991 | B1 | 4/2001 | Salek-Nejad | |
| 6,341,877 | B1 | 1/2002 | Chong | |
| 6,367,208 | B1 * | 4/2002 | Campbell et al. | 52/169.13 |
| 6,454,488 | B1 | 9/2002 | Lewis, Sr. et al. | |
| 6,702,512 | B1 | 3/2004 | Reale | 404/6 |
| 6,805,515 | B2 * | 10/2004 | Reale | 404/11 |
| 7,118,304 | B2 * | 10/2006 | Turpin et al. | 404/6 |
| 2003/0127636 | A1 | 7/2003 | Piron | |
| 2004/0033106 | A1 * | 2/2004 | Turpin et al. | 404/6 |
| 2004/0067104 | A1 | 4/2004 | Venegas | |
| 2004/0190990 | A1 | 9/2004 | Blair | |
| 2005/0201829 | A1 | 9/2005 | Dehart | |
| 2006/0090408 | A1 * | 5/2006 | Darcy | 52/174 |
| 2008/0205982 | A1 | 1/2008 | Peng | 404/6 |
| 2008/0038056 | A1 | 2/2008 | Patel | 404/6 |
| 2008/0122756 | A1 | 5/2008 | Kawasaki et al. | 345/76 |
| 2009/0028638 | A1 | 1/2009 | Crawford et al. | 404/6 |
| 2009/0035061 | A1 | 2/2009 | Crawford et al. | 404/6 |
| 2009/0250674 | A1 * | 10/2009 | Darcy | 256/13.1 |

FOREIGN PATENT DOCUMENTS

| | | | |
|---|---|---|---|
| DE | 4004851 | * | 2/1990 |
| EP | 0009235 | | 4/1980 |
| EP | 0 955 414 | | 11/1999 |
| EP | 1 054 108 | | 11/2000 |
| EP | 1 479 826 | A2 | 11/2004 |
| FR | 2057107 | | 4/1971 |
| GB | 2 194 577 | A | 3/1988 |
| GB | 2 229 472 | | 9/1990 |
| JP | 10176314 | | 6/1998 |
| JP | 11061746 | | 3/1999 |
| JP | 2001295298 | | 10/2001 |
| WO | WO 02/081824 | | 10/2002 |

OTHER PUBLICATIONS

International Search Report, Mar. 20, 2007, 1 pg.
http://web.archive.org/web/20020525043057/http://globalsecurity.org/military/library... dated Feb. 12, 2007, 9 pgs.
Department of Defence Handbook, "Selection and Application of Vehicle Barriers" MIL-DDBK-1013/14, Feb. 1, 1999.

* cited by examiner

FIG. 15
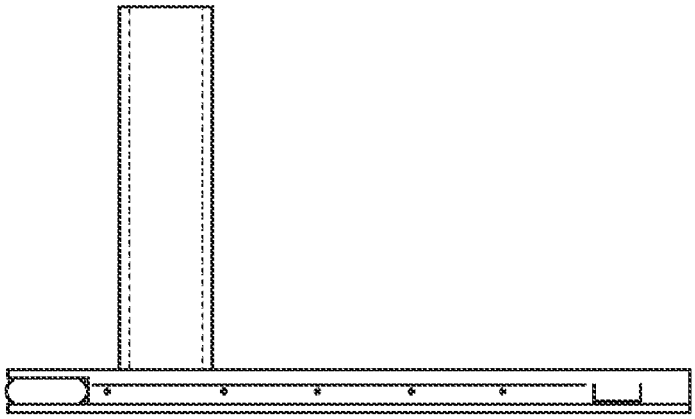
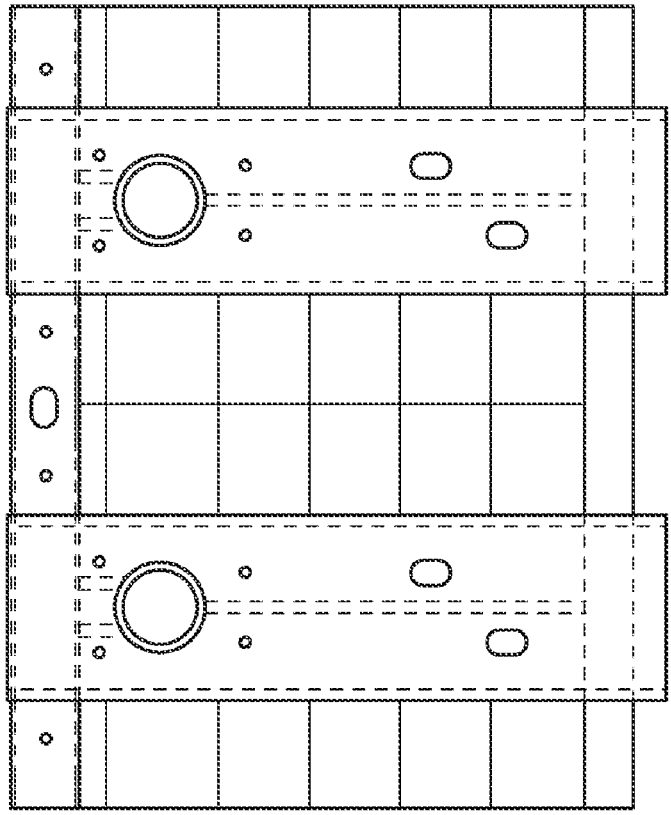
FIG. 16

ANTI-RAM SYSTEM AND METHOD OF INSTALLATION

CROSS-REFERENCE TO RELATED APPLICATIONS

This Application is a continuation of and claims priority of U.S. application Ser. No. 11/191,251 filed Jul. 26, 2005, now U.S. Pat. No. 7,699,558, which claims the benefit of the six provisional patent applications identified below. This Application also claims the benefit of these six provisional patent applications identified below, and incorporates herein by reference the entire contents and teachings of the six provisional patent applications identified below and the entire contents and teachings of application Ser. No. 11/191,251. The six provisional patent applications are:

U.S. Application No. 60/591,018 for Foundation module for anti-ram devices where subsurface clearances are minimal, by Richard Steven Adler and John Crawford, filed Jul. 26, 2004.

U.S. Application No. 60/600,955 for Anti-ram foundation pad, by Richard Steven Adler and John Crawford, filed Aug. 12, 2004.

U.S. Application No. 60/605,959 for RSA/K&C anti-ram foundation pad, by Richard Steven Adler and John Crawford, filed Aug. 30, 2004.

U.S. Application No. 60/622,385 for RSA/K&C anti-ram foundation pad with attached surface elements, by Richard Steven Adler and John Crawford, filed Oct. 26, 2004.

U.S. Application No. 60/674,965 for RSA/K&C anti ram bollards and RSA/K&C anti-ram headknocker, by Richard Steven Adler and John Crawford, filed Apr. 25, 2005.

U.S. Application No. 60/679,547 for RSA/K&C anti-ram bollard pad extension sleeves with integral structural integrity, by Richard Steven Adler, John Crawford and George Heyward, filed May 9, 2005.

FIELD OF THE INVENTION

The present invention relates to the assembly and installation of bollard systems for use in protecting building and other structures from being rammed by vehicles. It also relates to the adaption of bollard systems to varying installation requirements, and the disguising of the bollards to make them appear to be part of a normal landscape around a building or structure.

BACKGROUND OF THE INVENTION

A well know activity of terrorists is to crash a vehicle loaded with explosives or incendiary material into a building or other structure, so as to inflict damage to the building or other structure, and to harm the people in the building or structure. Various bollard constructions and methods of installation have been proposed and utilized in the past. Typically these bollard installations required rather deep excavations, several feet or more, to receive the base for a group of bollards. Alternatively, individual bollards were anchored by boring deep holes to receive the lower end of the bollard.

With the increased threat of terrorism, it has become desirable, and to some extend even necessary, to provide bollard protection to existing buildings in a well developed urban or commercial area. Typically it is desirable to locate the bollards between the building or other structure and the adjacent streets or roadways. Quite often buried below the surface of the space between a building or other structure and the street are utilities such as gas, water, electric, and telephone or other communication lines and related components. Thus, to provide a deep excavation for the base of a bollard system is difficult if not impossible. While the underground utilities, could be moved to make way for the deep excavation for the base of a bollard system, to do so would be quite costly, and considerable construction time would be required. Such construction would not only most likely result in disruption of the utility services, but more so disrupts travel on the street and pedestrian traffic on the sidewalk between the building and the street.

It would therefore be desirable to provide a bollard system which would require very little or no excavation for the base of the bollard system, and which bollard system could be partially or completely preassembled and readily delivered to the installation site for placement and final assembly. It would be further desirable that the bollard system be readily adaptable to different terrain and installation requirements. For instance, it should be adaptable to installation on slopes, around corners, and in other none straight line applications. Further, it should meet installation requirements such as allowing for vents and access to underground vaults, and accommodating fire hydrants and street lighting poles. Further, it should provide for ramps for handicap access to the building or structure, and even for removal of one or more bollards to provide vehicle access to the building when occasionally needed.

SUMMARY OF THE INVENTION

In accordance with this invention, a bollard system is provided which requires very little or no excavation for the base of the bollard system, and which can be partially or fully assembled prior to bringing it to the installation site. The bollard system of this invention includes one or more bollards secured to a shallow mounting pad or base. The shallow mounting pad or base of the bollard system of this invention may be formed or constructed in various ways and of various materials. In all cases, the shallow mounting pad or base is designed to made of heavy materials, so as to have considerable mass.

The major benefit in the physics of the bollard system of this invention, is that the striking forces from the crash vehicle are transmitted from the bollard down to the shallow mount pad (5" to 14" in depth) in a way that is different from standard deep trench foundations (4' to 6'). The shallow mount pad is pushed down onto the soil (horizontal force backwards) instead of into the soil (vertical force downwards) as in the case of deep trench foundations.

The shallow base system makes for a much more effective and efficient load transfer into the soil which reduces the overall volume of displacement of soil by the base, as compared to the standard deep trench foundation systems. The shallow base system of this invention also provides a more efficient foundational system.

One of the issues with the deep trench system is that the lateral compliance at the top of the trench is quite low: If there is no strong resistive force at the top of the trench, then there is a greater chance of more rotation of the bollard which would permit the crash vehicle to breach the system, thereby obviating the crash control device. In the shallow mount bollard system of this invention, the resistive forces are all at the base of the bollard (at the top of the trench) and therefore reduce the likelihood of the bollard rotating and vehicle breaching the security system.

The bollard system of this invention works as the crash vehicle strikes the bollard near its top edge translating the forces from that impact to the base of the bollard. The forces at the base of the bollard are transmitted to the foundation pad or base, and from there into the soil or concrete depending on what the unit is seated on. The resistance force is of the reverse order stated above.

The bollard system of this invention is able to become more shallow (14" to 6.5" to 3") by controlling the compliance supplied by the foundation to resist the rotation at the base of the bollard. Specifically the bollard system of this invention can utilize a more shallow trench by more efficiently transmitting the loads to the support media (soil or concrete). The more efficient transfer of the impact load is also accomplished by the addition of either one, a group or all of the following enhancements: 1) a wider base; 2) a heavier base; 3) longer base (laterally and tying adjacent units together); 4) increasing the efficiency of the grillage; 5) stiffer base; 6) ability to place bollard in different locations in the base (for example placing the bollard at the back of the base makes the system weaker), 7) the addition of internal stiffeners both inside the tubes forming the base and inside the pipe forming the bollard, and 8) others.

While in the preferred embodiment of this invention the base or pad is rectangular, other shapes can be used, such as angled and curved bases, zigzags, and indented, so as to go around an appurtenance.

In the preferred embodiment of this invention the frame or grill of the base and the bollards are formed of structural steel members. The amount of weldment required to assemble the frame or grill of the base and the bollards is dependant upon the availability of stock or over the counter materials. If more stock or over the counter materials are usable and available then less weldment is required to connect pieces and create a stronger base grillage.

Another major benefit of the shallow trench system of this invention is realized in its accommodation of site constraints (such as not interfering with underground utilities, able to install at sites where there is limited access to underground excavation (presence of vaults, basements), not interfering with vegetation, etc.

The base or pad in a preferred embodiment or the bollard system of this invention is constructed using a series of structural tubes to form a grillage (ie. pipes, tubes, channels and sometimes angles) to produce rigidity of the pad or base against upheaval and torsion forces. The grillage is a framework for supporting the load imparted by the bollard. The framework means the tubes (or other structural steel elements) tied together to form the grillage. The base or pad is completed on site, by filling the shallow excavation and grillage with concrete to form a finished foundation unit. It is preferred that the concrete be in contact with the soil or existing concrete at the base of the excavation in order to improve the resistance of the lateral motion of the pad. The top surface of the pad is to be formed in such a way to support the materials forming the final finished appearance (non-structural stone pavers or tiles, etc.).

The shallow base or pad concept of this invention differs from the standard deep trench system because it only requires a simple replacement of area near the surface, thereby significantly reducing the interference with any existing underground objects at the site. Unlike a deep trench footing, detailed inspection of pre-existing underground conditions, are not required. With the standard trench, personnel inspectors and multiple tools are required to hold the trench open, issues also arise with rain water or other media spilling into the trench.

The physics of the interaction of the base or pad of the bollard system of this invention with supporting media (soil or concrete) is different than that of the deep trench system, in that the forces imparted by the pad or base are much less than the forces imparted by the deep trench foundation. This is partly due to the large support area of the pad as compared to the deep trench foundation—the vertical forces being carried by the bottom edge of the trench foundation and the horizontal forces being carried by the top few inches of the trench foundation in a deep trench foundation, as compared to the horizontal forces being provided by the frictional forces being between the pad and media over the entire area of the pad and the vertical forces between the pad and media being carried over the entire area of the pad. The area of the pad or base in the bollard system of this invention may be reduced by the addition of engineered stiffeners, tying adjacent pads together, larger section modulus parts, larger welds, etc.

Restated, the area of a deep trench foundation interacting with the media is significantly smaller than the area of the pad interaction with the media in the system of this invention, thus the forces transferred to the media are far less than the forces transferred by the trench footing to the media. The pad or base of this invention spreads the forces out while the deep trench footing concentrates the forces which require the trench footing to be massive and deep. The deep trench footing for comparable performance will always have to be more massive than the pad or base of this invention.

The pad or base of the bollard system of this invention is superior in design because it transmits the load more efficiently to the foundation (ground) than a deep trench design, thus allowing a smaller device to absorb the same or greater amount of energy than a more onerous design.

The shallow pad or base of the bollard system of this invention supports the development of corner units with inherent advantages over a deep trench foundation. The shallow base of the system of this invention allows for complex geometry at corners, thereby facilitating ADA access and foot traffic by allowing bollards to be placed in an optimal pattern for pedestrian traffic without regard to the excavation needed to support the bollards. This is achieved by taking advantage of the flexibility in bollard placement offered by the grillage concept that allows the bollards to be placed anywhere in the grillage. Whereas with deep trench footing, the bollards necessarily need to be lined up with the trench itself. In order for the deep trench to support out of line placement of bollards, it would have to be the full width of the bollard pattern whereas only an excavation of the shape of that pad needs to be made in accordance with this invention.

The flexibility of the bollard system of this invention permits the extension of a pad in any one direction for any unique situation for the bollard to be supported by the pad, but not beyond the pad. This is achieved by extending a tube connected to the grillage in any desired direction and placing (anchoring) a bollard in the tube.

In certain situations, site encumbrances may not allow a pad or base to be used where it is desirable to place one or more bollards. Extending one or more horizontal connector tubes between spaced pads achieves the necessary anti-ram capability without requiring additional excavation for the pad itself. In a specific embodiment, a connector tube, either above or below ground, can be secured at its ends to the grillage of two adjacent pads with the ends of one or more bollards placed in vertical holes formed in the connector tube. The physics behind this inventive concept is that the torsional rigidity of the connector tube is being used to resist the motion of the bollard, instead of upheaval or moment resistance of the tube used in the standard pad design. That is, when a vehicle strikes the bollard in the conventional design the tube supporting the bollard on axis with the impact is the tube that resists the motion of the bollard using its moment capacity, while in this alternate construction, the tube resists the motion of the bollard with its torsional capacity, bending not twisting.

Another variation of this invention provides removable units in which the bollard is temporarily removed for access through the on-center spacing and then replaced for its anti-ram purpose. The method to achieve this without a fixed bottom weld is the addition of an extra thick steel sleeve connected to the base of the grillage, with the bollard being slipped into and out of the sleeve. Additional bolts or a variation of locking mechanisms provide security to prevent unauthorized personnel from removing the removable bollard.

When using the shallow base of pad system of this invention, it may be necessary to place the pad over an air vent or access open to an underground space. To accommodate this need, the grillage is formed to provide an open space located over the air vent or access opening. A form is provided around the open space, such that when concrete is introduced into the grillage, it does not enter the open space. Once the base of the pad system is completed, the usual grate or grill can be placed over the opening.

While it is desirable in accordance with this invention to have the pad extend further in the direction of expected impact, that is on the opposite side of the bollard from the side of impact, than on the side of impact, some applications may require a reversal of the extension. For instance, if it becomes necessary to move the bollards farther away from the road, that is closer to the building being protected, a bollard unit in accordance with this invention may be lifted, rotated 180 degrees and replaced. This rotation will place the bollards closer to the building and farther away from the road. The bollard system of this invention also makes possible the temporary removal of the bollards and the supporting base. For instance, if it becomes desirable to access something under the bollards, the bollards and connected base may be lifted and temporarily removed. This would not be feasible with a deep trench bollard system.

The bollard system of this invention does not lend itself to the installation of a single bollard, since without an extended base or pad, there is not sufficient resistance to stop the rotation of the pipe bollard. However, a feature of this invention is to provide a single bollard with a supporting pad, such that if a single bollard is damaged in a row of bollards, the damaged bollard and its supporting pad may be cut out of the row of bollards and the supporting pad of the single replacement bollard secured to supporting pads of the adjacent bollards.

In its most basic form the bollard system of this invention would have its base or pad formed of a continuous flat piece of steel with holes cut out for the bollards. The plate would need a minimum depth 5" to qualify as a DOS rated system. The cross pieces are inherent in the continuous plate. Still another basic configuration of the bollard system of this invention is to bolt separate thick pieces of steel to continuous cross plates, and to have the bollard set inside that construction. Again, 5" thick steel would be required to have two plates 5" apart.

BRIEF DESCRIPTION OF THE DRAWINGS

FIG. 15 is a typical section view of the steel layout shown in FIG. 12;

FIG. 16 is a top elevation view similar to FIG. 13. Showing the steel and rebar layout;

DETAILED DESCRIPTION OF THE PREFERRED EMBODIMENT

Figure 1:
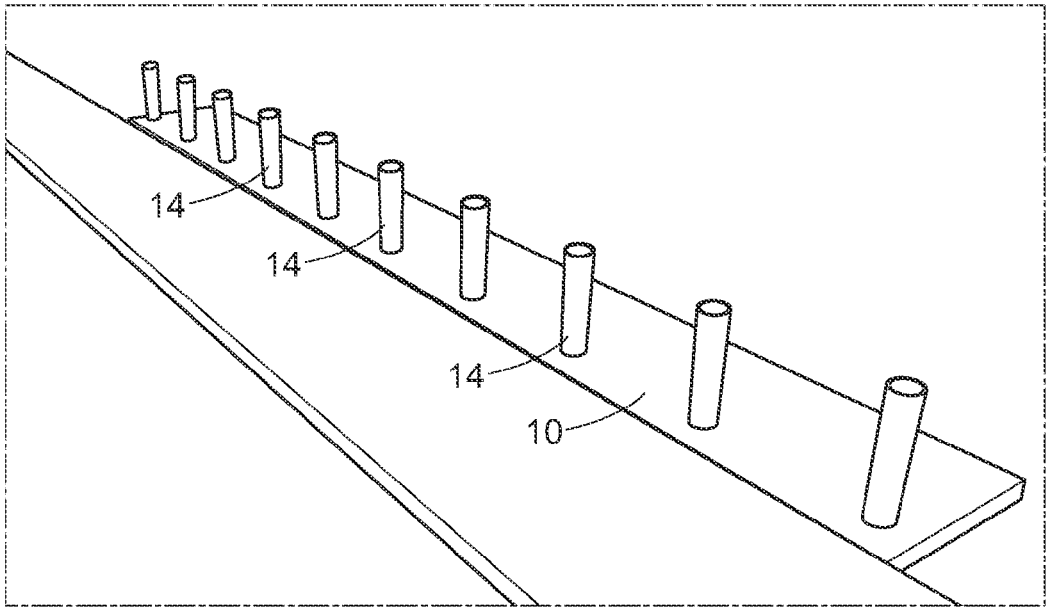
FIG. 1 is a perspective view of the anti-ram system of this invention installed alongside the edge of a sidewalk, prior to the pad being covered with a landscaping surface.
Figure 2:
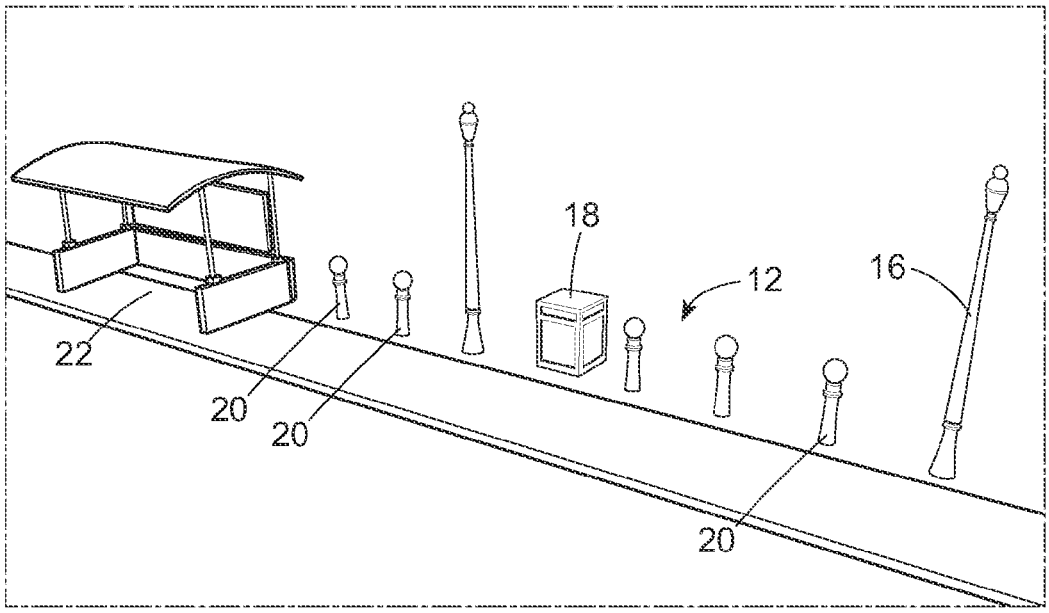
FIG. 2 is a perspective view of the anti-ram system of this invention as shown in FIG. 1, with a landscaping surface applied over the pad, and with the bollards covered by ornamental and functional items.

FIG. 1 shows an embodiment of the anti-ram system of this invention installed in a shallow trench alongside a sidewalk. The top surface 10 of the base or pad of the anti-ram system is shown recessed below the desired grade level. As shown in FIG. 2, a landscaping surface, such as grass 12 is placed over the top surface 10 of the base or pad. As further shown in FIG. 2, ornamental or functional objects are placed over the bollards 14 shown in FIG. 1. Such objects include lamp posts 16, waste container 18, ornaments 20, and a seat and shelter 22. The ornamental and functional items disguise the presence of the bollards of the anti-ram system.

Figure 3:
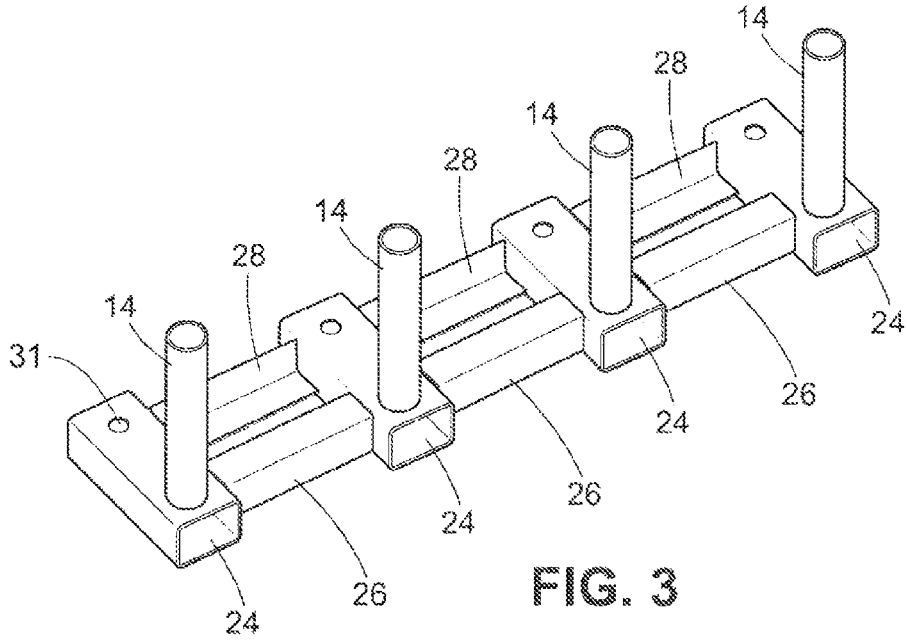
FIG. 3 shows an embodiment of this invention with four bollards mounted on the framework for the pad or base of the anti-ram system.

FIG. 3 shows an embodiment of this invention with four bollards 14, mounted on the steel framework 23 for the pad of the anti-ram system. The framework 23 includes transversely extending tubular members 24, longitudinally extending tubular members 26, and longitudinally extending angle members 28. In a preferred embodiment of this invention, the tubular members 24 and 26 have a rectangular cross-section, such that they form a generally planar upper and lower surface for the pad. The longitudinally extending tubular members 26 are welded to the sides of the transversely extending tubular members 24. Depending on the strength requirements of a particular anti-ram system, the welds can be fillet welds or full penetration welds on all four sides of the tubular members 26. Similarly, the longitudinally extending angle members 28 are welded to the sides of the tubular members 24 by either full penetration or fillet welds. Alternatively, angular notches can be cut in the transversely extending tubular members 24 for the longitudinally extending angle member to pass through, in which case the angle member may be formed as one continuous piece. Holes are provided in the transversely extending tubular members 24 to receive the cylindrical bollards 14. Again, the cylindrical bollards are secured to the tubular members 24 by fillet or full penetrations welds at both the upper and lower surfaces of the tubular members 24. Apertures 31 are provided in both tubular members 24 and 26, such that they may be filled with a material such as concrete, to add strength and weight to the base or pad.

Figure 4:
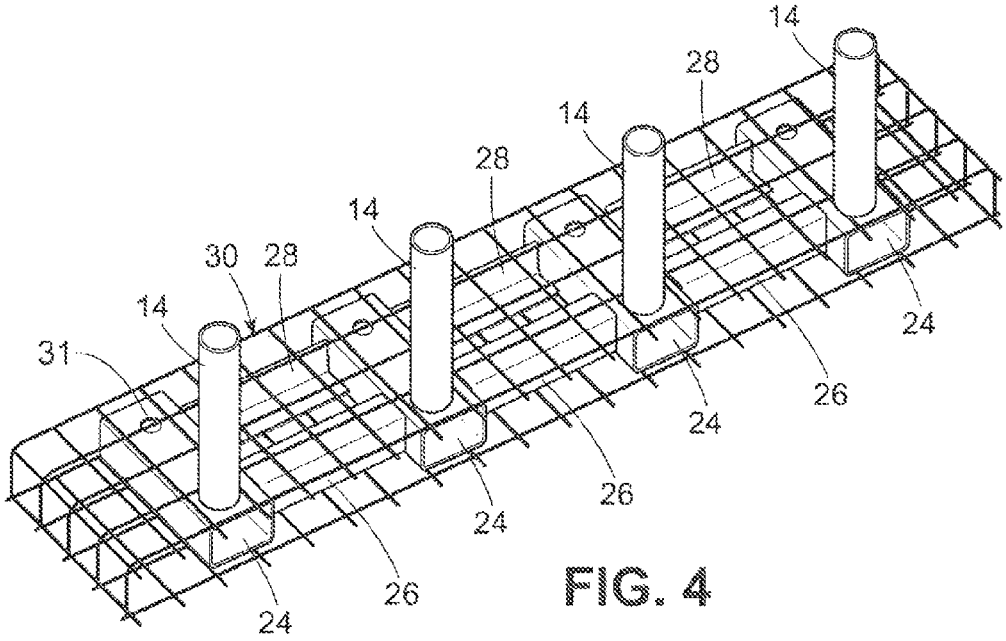
FIG. 4, shows the embodiment of this invention shown in FIG. 3, with a rebar cage surrounding the framework for the pad or base.

FIG. 4, which is similar to FIG. 3, shows a rebar cage, or grillage 30 placed around the steel framework 23. The rebar cage includes an upper portion on top of the tubular members 24 and 26 and a lower portion under the tubular members 24 and 26. The rebars forming the cage 30, are welded to the tubular member 24 and 26.

Figure 5:
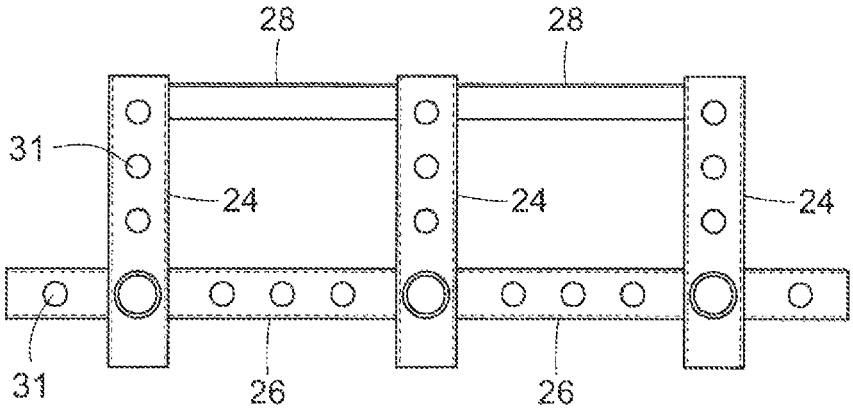
FIG. 5 is a top plan view of the steel layout for the base of a set of three bollards in accordance with a preferred embodiment of this invention.
Figure 6:
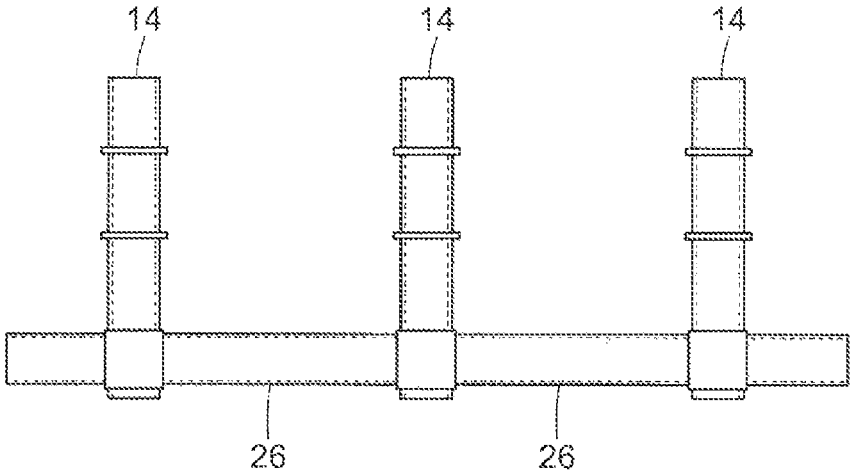
FIG. 6 is a side elevation view of the steel layout of FIG. 5.
Figure 7:
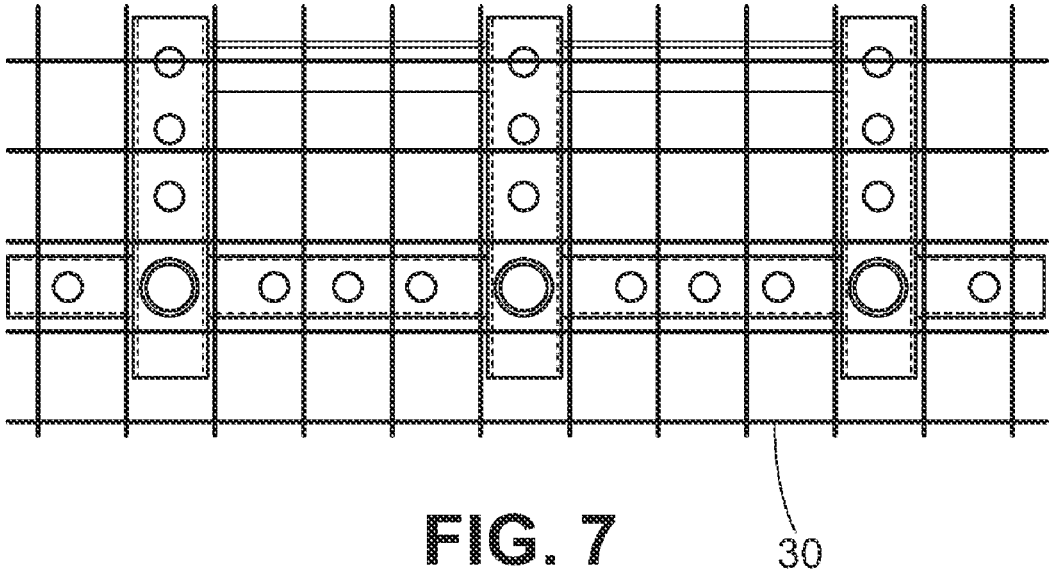
FIG. 7 is a top plan view of the steel layout shown in FIG. 5, showing in addition the layout of rebars forming a grill or cage around the rebars.
Figure 8:
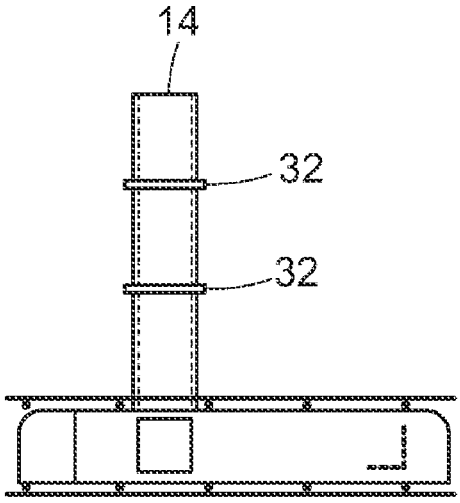
FIG. 8 is a side elevation view of the steel and rebar layout shown in FIG. 7.
Figure 9:
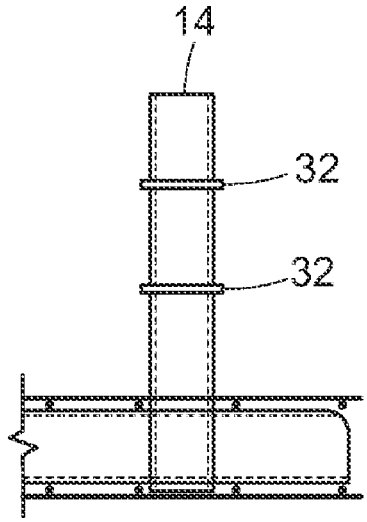
FIG. 9 is an end elevation view of the steel and rebar layout shown in FIG. 7.
Figure 10:
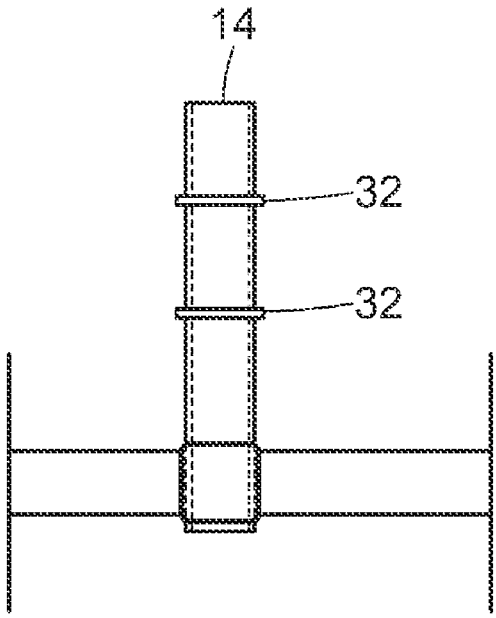
FIG. 10 is an end elevation view of the steel layout of FIG. 5.
Figure 11:
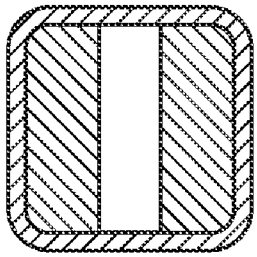
FIG. 11 is an end plate detail of the steel layout of FIG. 5.
Figure 12:
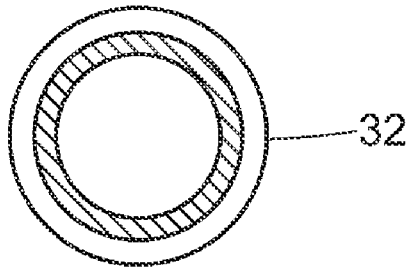
FIG. 12 is a cover strip shown encircling the bollards in FIGS. 6 and 8-10.
Figure 13:
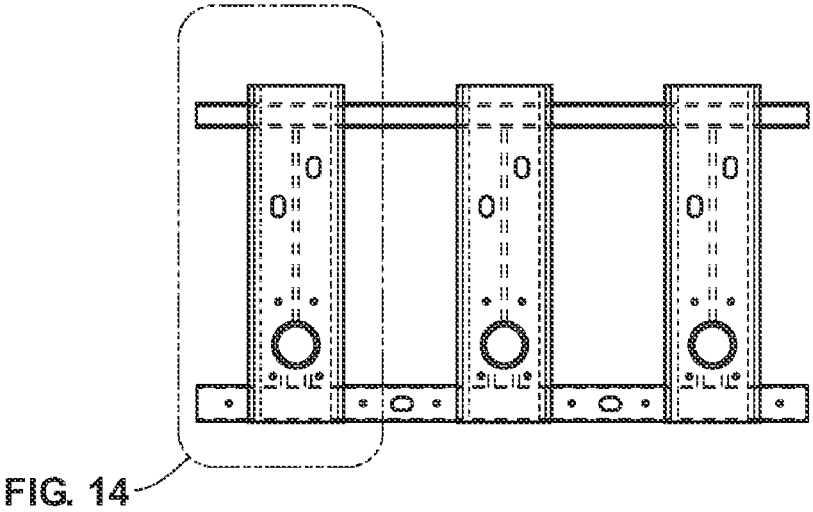
FIG. 13 is a top plan view of the steel layout for the base of a set of three bollards in accordance with a second preferred embodiment of this invention.
Figure 14:
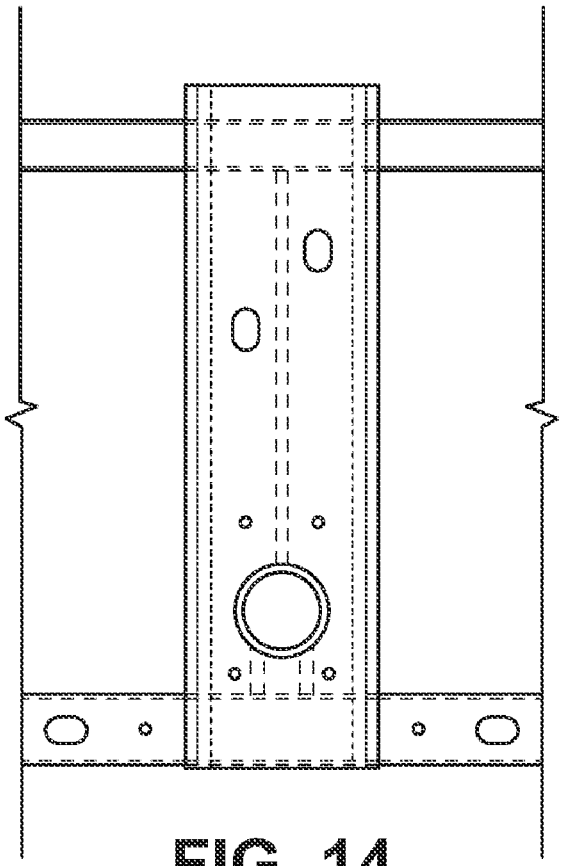
FIG. 14 is a detailed top plan view of the steel layout encircled by the line A-A in FIG. 13.
Figure 17:
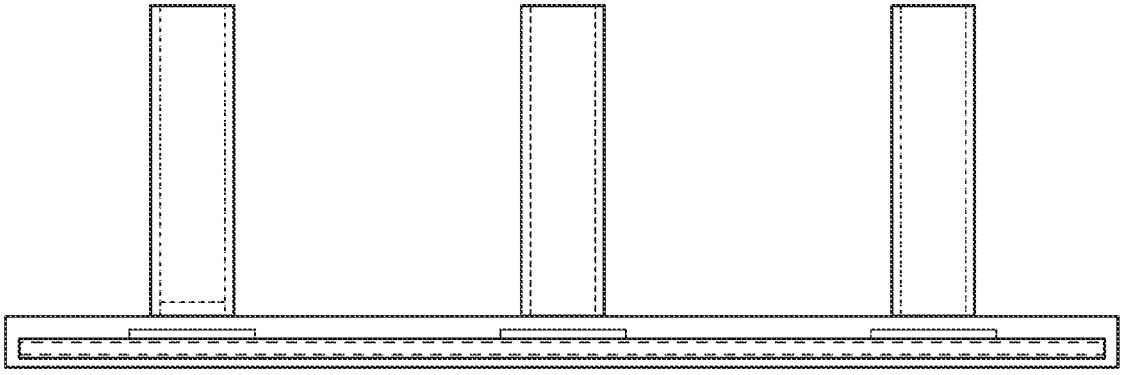
FIG. 17 is a typical elevation view of the steel and rebar layout shown in FIG. 16.
Figure 18:
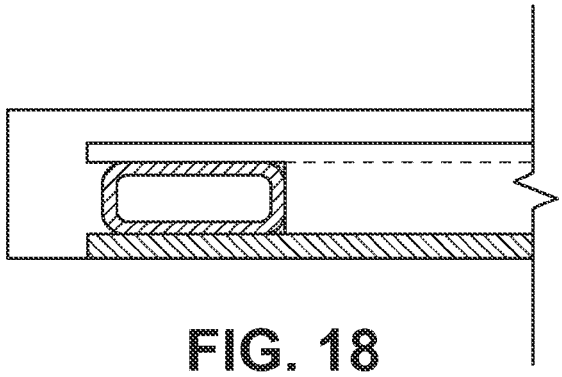
FIG. 18 is a cross-sectional view of the longitudinal tubular member located adjacent to the bollards in FIG. 13.
Figure 19:
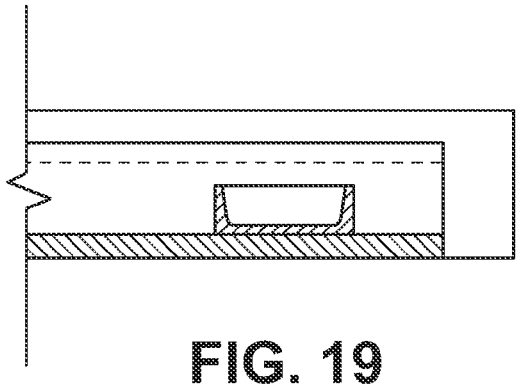
FIG. 19 is a cross-sectional view of the longitudinal channel member located at the rear end of the transversely extending members in FIG. 13.
Figure 20:
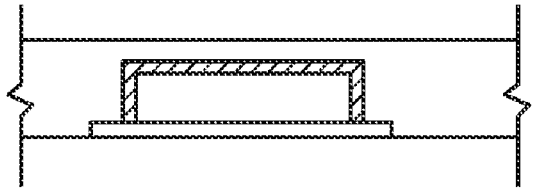
FIG. 20 is a detail of a front stiffener as used in the transversely extending member shown in FIG. 13.
Figure 21:
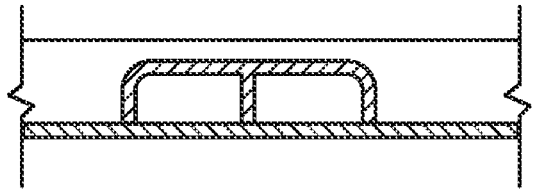
FIG. 21 is a detail of a rear stiffener as used in the transversely extending member shown in FIG. 13.
Figure 22:
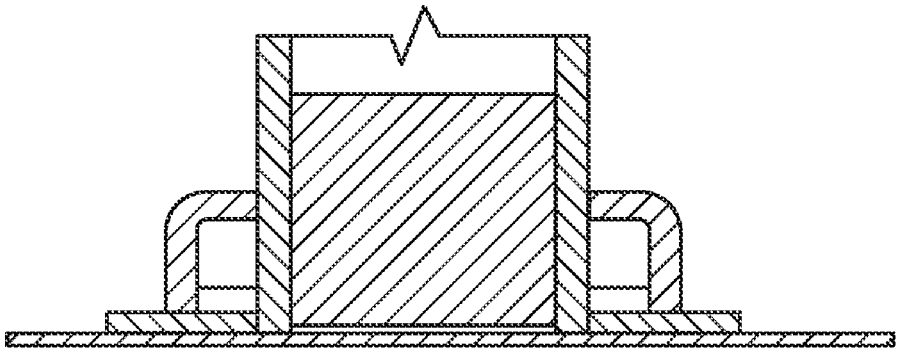
FIG. 22 is a cross-sectional view of the support arrangement for the bollard tube, including a solid circular steel bar in the center of the tube.
Figure 23:
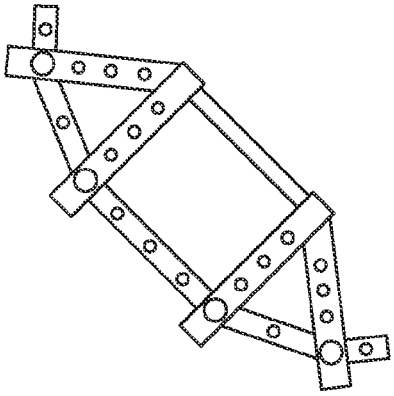
FIG. 23 is a top elevation view showing the layout of the steel members for forming the framework for a pad designed to support bollards at a corner.
Figure 25:
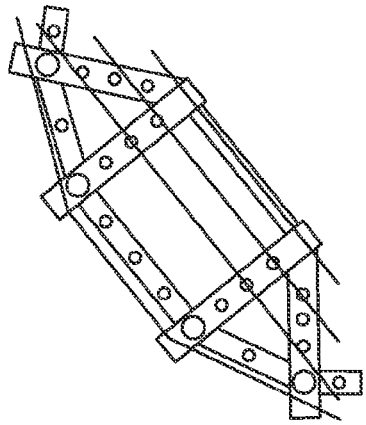
FIG. 25 is a top elevation similar to FIG. 23 showing the location of rebars used in the corner.
Figure 24:
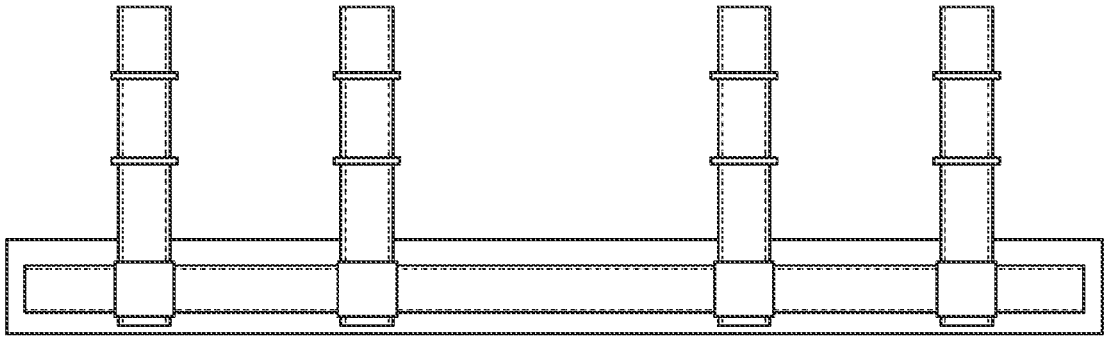
FIG. 24 is a side elevation view of the corner pad and bollards shown in FIG. 23.
Figure 26:
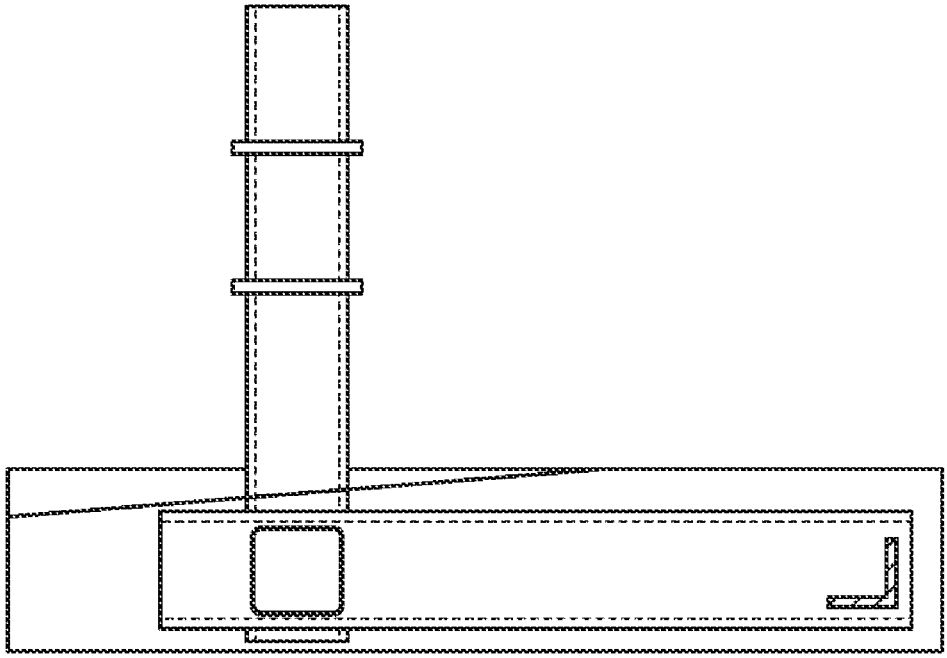
FIG. 26 is a side elevation view of the corner pad and rebars as shown in FIG. 25.
Figure 27:
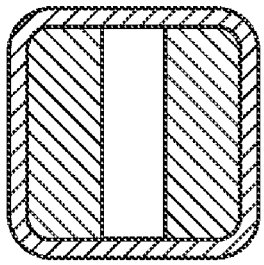
FIG. 27 is a cross-section view showing a stiffener place in the end of the transversely extending members shown in FIG. 23.
Figure 28:
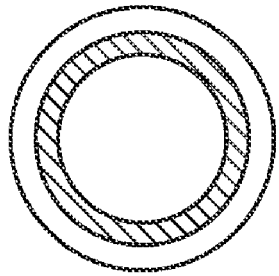
FIG. 28 is a cross-sectional view of the support arrangement for a bollard in the framework shown in FIG. 23.
Figure 29:
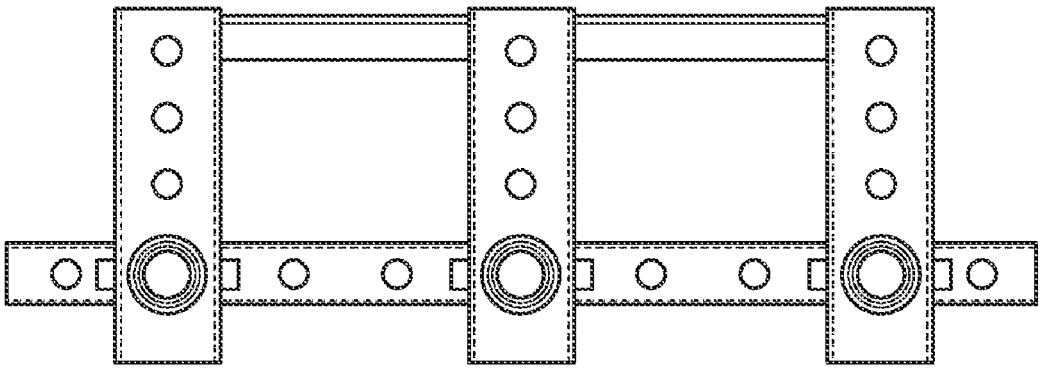
FIG. 29 is a detailed top plan view of the steel frame layout for a pad in accordance with this invention wherein the bollards are removable so as to provide access to the protected structure.
Figure 30:
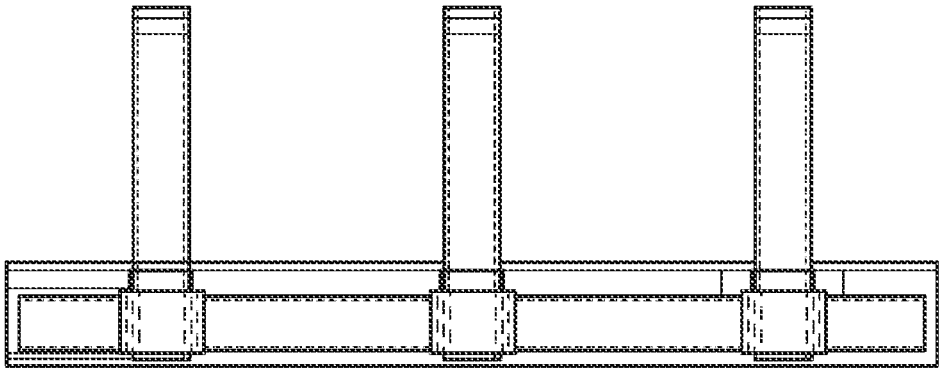
FIG. 30 is a side elevation view of the steel frame shown in FIG. 29, showing the reinforced steel socket provided for receiving the lower end of a bollard.
Figure 31:
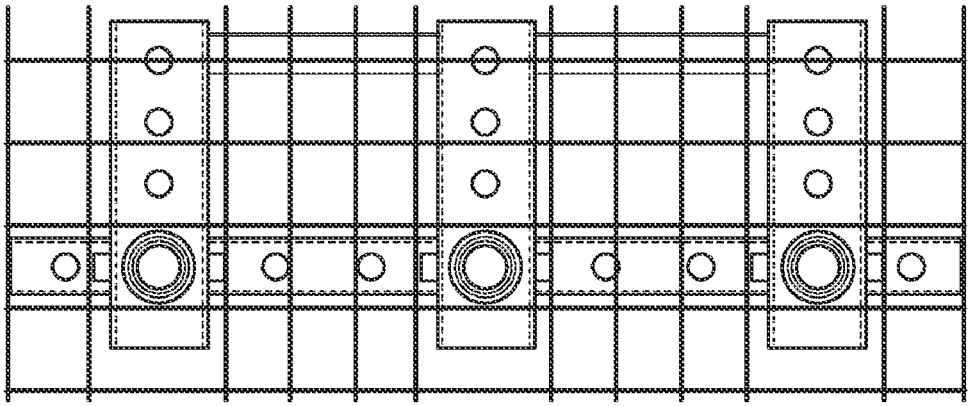
FIG. 31 is a detailed top plan view similar to FIG. 29 showing the placement of the rebars on the steel frame.
Figure 32:
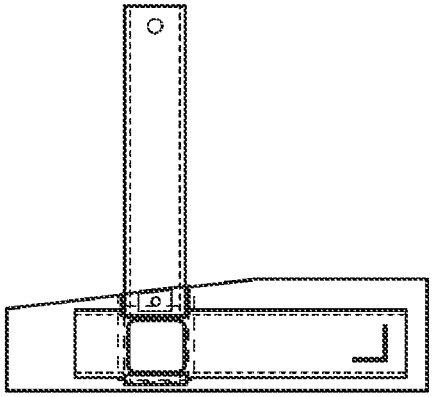
FIG. 32 is side sectional view of the steel frame and bollard shown in FIG. 29.
Figure 33:
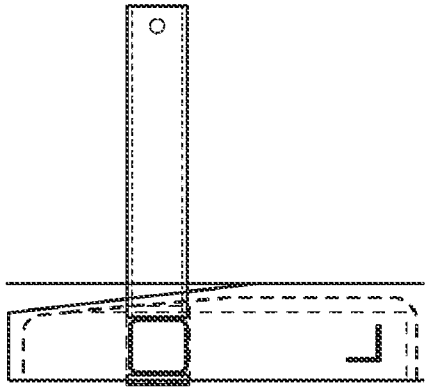
FIG. 33 is an end view of the steel frame and bollard shown in FIG. 29.
Figure 34:
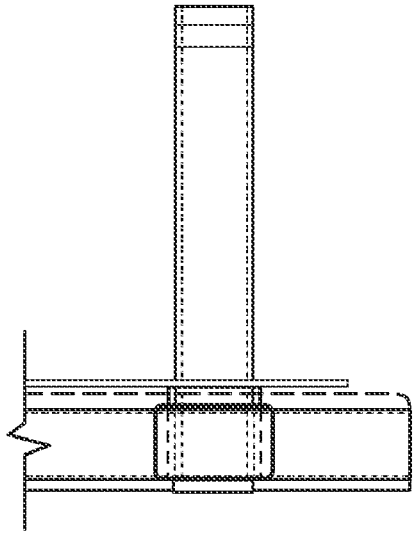
FIG. 34 is an end sectional view of the frame reinforce steel socket and bollard as shown in FIG. 29.
Figure 35:
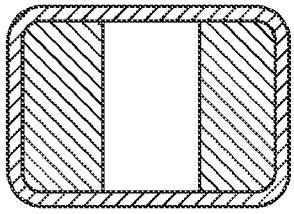
FIG. 35 is a cross-section view showing a stiffener place in the end of the transversely extending members shown in FIG. 29.
Figure 36:
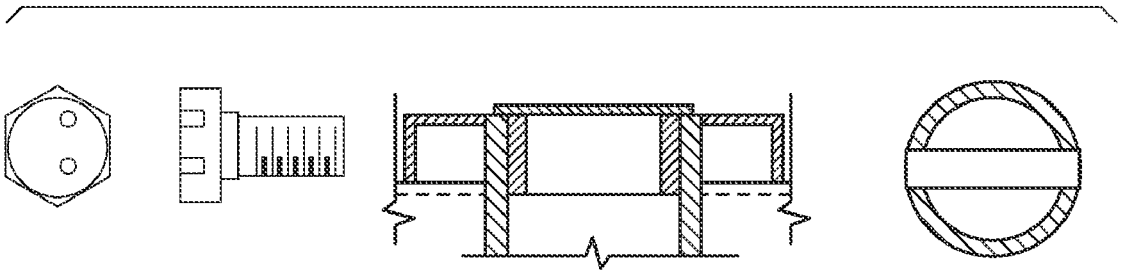
FIG. 36 show an arrangement including a bolt for securing a bollard in a socket as shown in FIG. 29.
Figure 37:
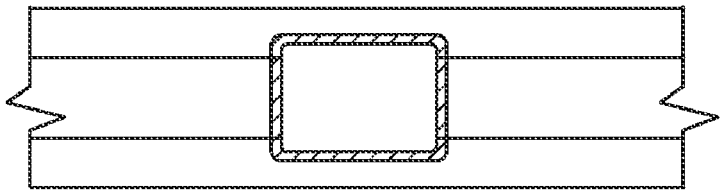
FIG. 37 is a cross-sectional view of a typical end section of the steel frame shown in FIG. 29.
Figure 38:
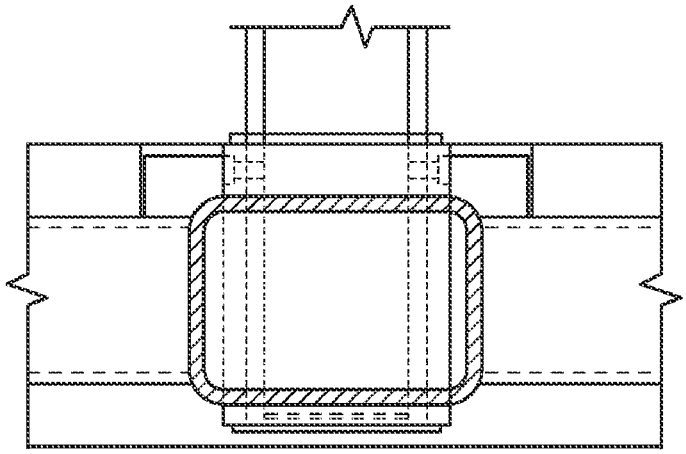
FIG. 38 is an detailed cross-sectional view of the socket and locking or securing arrangement for a bollard mounted in the steel frame shown in FIG. 29.
Figure 39:
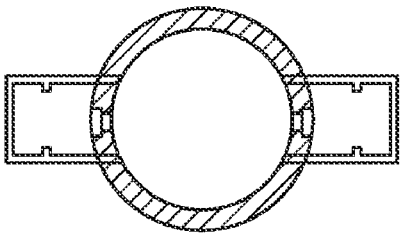
FIG. 39 is a cross-sectional view shown the enclosure provide for the locking or securing arrangement shown in FIG. 36.

FIG. 5 shows a top plan view of a framework for a typical set of three bollards, and FIG. 6 shows a side elevation of the same framework constructed in accordance with this invention. FIG. 7 shows an elevation view of a rebar cage or grillage secured to the framework shown in FIG. 5. FIG. 8 is a typical side section view of the rebar cage and framework shown in FIG. 7, and FIG. 9 is a typical front end section view, while FIG. 10 is a typical rear end section view. FIG. 11 is a cross-sectional detailed view of an end plate secured in the tubular member 24. A gap is provided in the end plate to provide for the filling of the tubular member with a material such as concrete. FIG. 12 is a detailed cross-section of one of the cover strips 32 provided on the bollards 14. FIGS. 5-12 are representative of a base or pad system in accordance with this invention which requires the provision of an excavation approximately 14 inches deep. The steel framework has a height of approximately 10 inches, the rebar cage adding approximately ½ inch to the height, and the encapsulating concrete adding another 1 and ½ inch, for a total of 12 inches.

FIGS. 13-22 are similar to FIGS. 5-12 in showing details of a second preferred embodiment of this invention. In this embodiment the base or pad is considerable thinner than that shown in FIGS. 5-12. In this embodiment the overall height of the pad could be only 6 and ½ inches, the steel frame having a height of 5 inches, with the rebar being located mid-height in the steel frame, rather that on the top and the bottom. The concrete adds 1 and ½ inches to the height of the pad.

Referring to FIGS. 23-28, it can be seen that by forming triangles with the transversely and longitudinally extending tubular members, it is possible to form a curved line of bollards.

Figure 40:
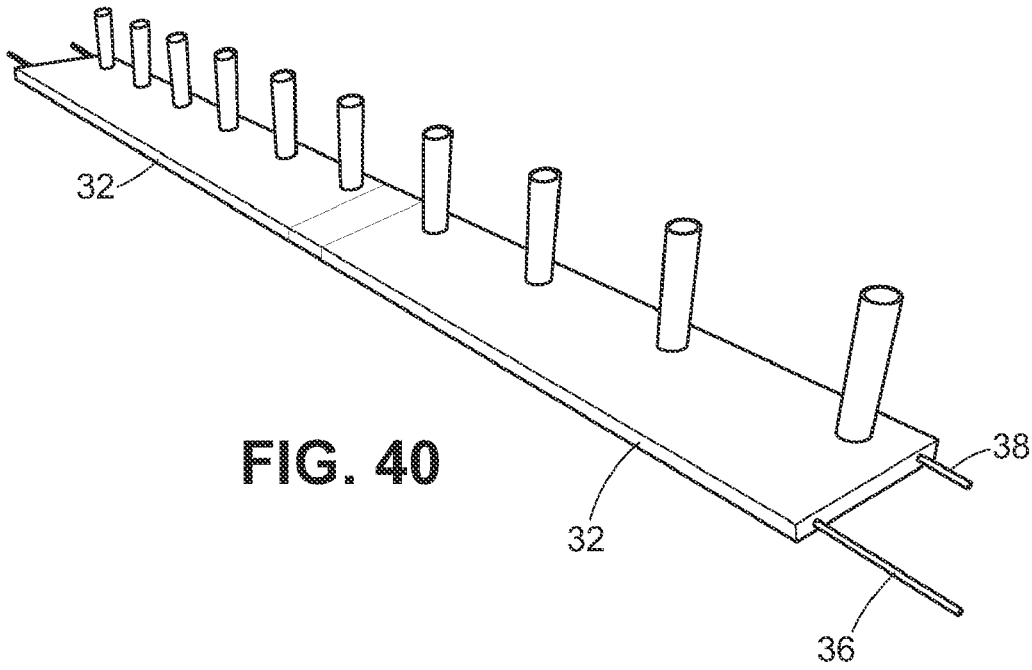
FIG. 40 is a perspective view of still another embodiment of this invention.

Referring to FIG. 40, two bollard pads 32, are shown spaced apart by a gap. Before the pads are filed with concrete, a pair of pipes are placed within the pads, such that post tensioning members can be passed through the pipes to secure the two bollard pads 32 to each other. Of course, any number of pads could be placed in alignment and secured by the post tensioning members.

Figure 41:
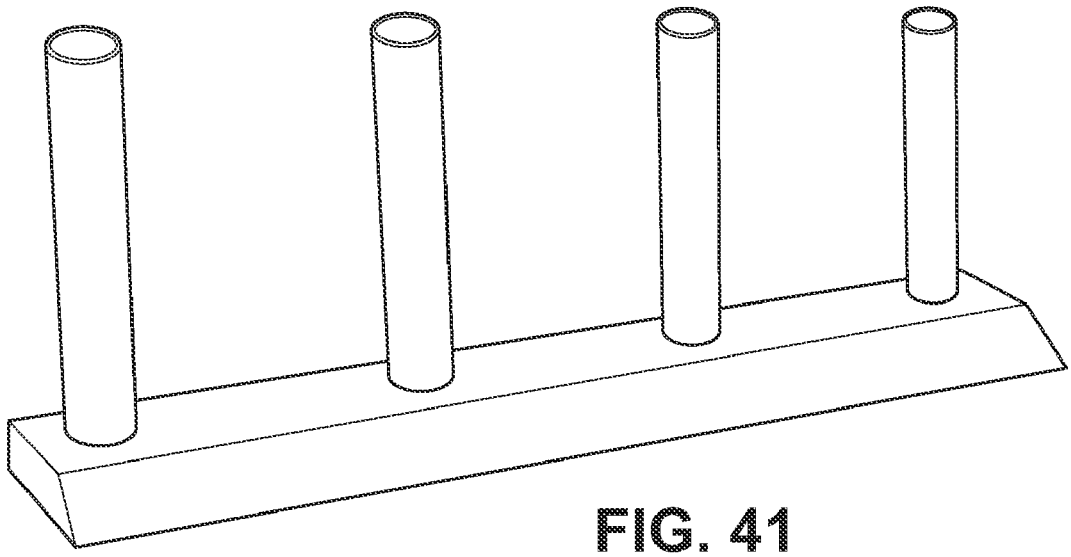
FIG. 41 shows still another embodiment of this invention, wherein the pad or base is surface mounted.
Figure 42:
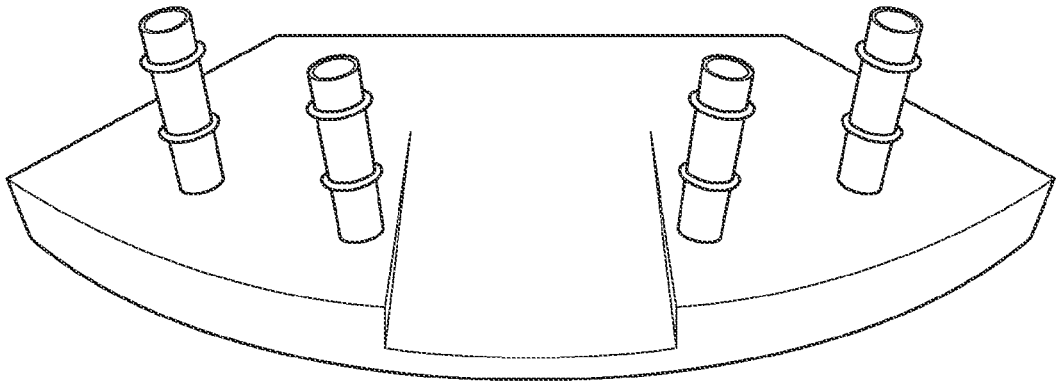
FIG. 42 is a perspective view of a corner or curved bollard system in accordance with this invention wherein the base is formed with a ramp for handicap access.

Referring to FIG. 41, the bollard system of this invention may be formed as a unit to be place on a surface for temporary bollard protection. The bottom surface is formed as a high friction surface, so as to resist sliding when an impact is received by the bollards.

Figure 43:
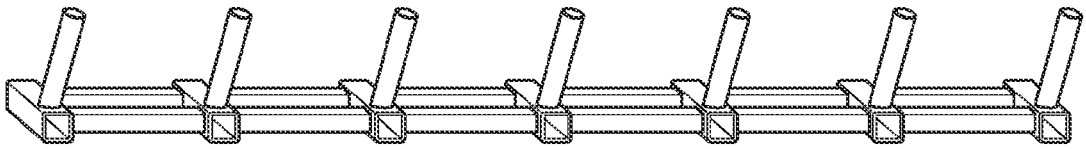
FIG. 43 is a perspective view of a steel frame formed for the base of a bollard system of this invention which is intended for placement on a slope.

Referring to FIG. 43 a perspective view of a steel frame formed for the base of a bollard system of this invention is shown, which is intended for placement on a slope. The bollards are secured to the base at an angle, such that when the base is placed on a slope, the bollards will be vertical.

Figure 44:
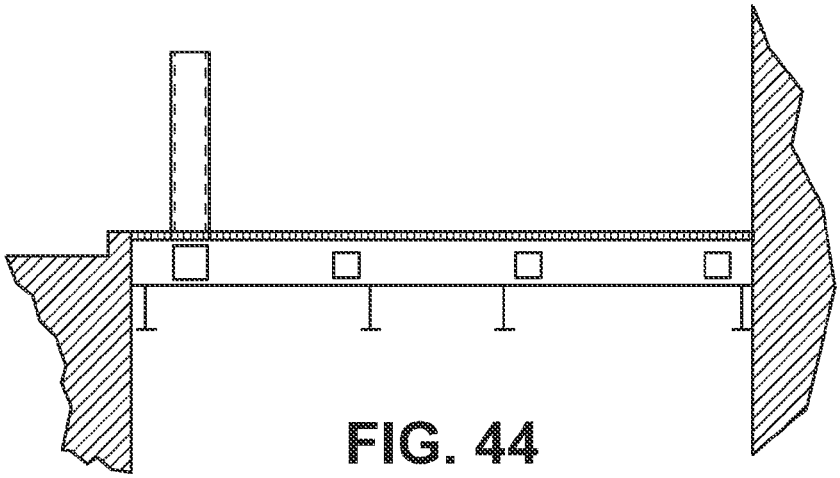
FIG. 44 is a perspective view of an embodiment of this invention wherein an opening is left is the base of the bollard system.

FIG. 44 shows an embodiment of this invention wherein an opening is left in the base of the bollard system to provide for an opening, such that when a grate is installed over the opening, an open space below the base is ventilated through the opening.

While only one embodiment of the invention has been shown, it should be apparent to those skilled in the art that what has been described is considered at present to be a preferred embodiment of the anti-ram system and method of installation of this invention. In accordance with the Patent Statute, changes may be made in the anti-ram system and method of installation of this invention without actually departing from the true spirit and scope of this invention. The appended claims are intended to cover all such changes and modifications which fall in the true spirit and scope of this invention.

The invention claimed is:

1. A bollard structure comprising:

at least one bollard; and a base comprising opposed ends and a plurality of structural members which intersect and are tied together, for each bollard of the bollard structure at least one first structural member extending from a first of the opposed ends of the base to a second of the opposed ends of the base in a first direction intersecting with the opposed ends, and at least one structural member extending to intersect with the at least one first structural member;

each bollard being secured to at least one of the at least one first structural member and the at least one structural member of the base for the respective bollard and extending upwardly from the base so as to transmit forces applied to the at least one bollard to the base;

wherein the base is configured to be mounted in a shallow excavation with the at least one bollard extending above grade; and wherein the at least one first structural member or the at least one structural member or both are configured or tied together to retain within the base supporting media introduced into the base when the base is mounted in the excavation such that the rotation is resisted of a bollard or bollards and the base from an impact against the bollard or bollards.

2. The bollard structure of claim 1, wherein at least one of the opposed ends is formed by a structural member to which an end of the at least one first structural member is secured.

3. The bollard structure of claim 1, wherein the intersecting structural members have axes that extend parallel to a plane of the base.

4. The bollard structure of claim 1, wherein the base has a height of 3 inches to 14 inches.

5. The bollard structure of claim 1, wherein the plurality of structural members comprise one or more tubular members.

6. The bollard structure of claim 5, wherein at least one tubular member comprises a pipe.

7. The bollard structure of claim 5, wherein at least one tubular member comprises a tube.

8. The bollard structure of claim 5, wherein at least one tubular member comprises an angle.

9. The bollard structure of claim 5, wherein at least one tubular member comprises a channel.

10. The bollard structure of claim 1, wherein the plurality of structural members comprises at least one tube.

11. The bollard structure of claim 1, wherein the plurality of structural members comprises at least one pipe.

12. The bollard structure of claim 1, wherein the plurality of structural members comprises at least one angle.

13. The bollard structure of claim 1, wherein the plurality of structural members comprises at least one channel.

14. The bollard structure of claim 1, wherein the plurality of structural members comprises at least one plate.

15. The bollard structure of claim 1, wherein the plurality of structural members comprise structural steel members.

16. A bollard structure comprising:

a plurality of bollards; and a base comprising opposed ends and a plurality of structural members which intersect and are tied together, for each bollard of the bollard structure at least one first structural member extending from a first of the opposed ends of the base to a second of the opposed ends of the base in a first direction intersecting with the opposed ends, and at least one structural member extending to intersect with the at least one first structural member;

each of the plurality of bollards being secured to at least one of the at least one first structural member and the at least one structural member of the base for the respective bollard and extending upwardly from the base so as to transmit forces applied to the at least one bollard to the base;

wherein the base is configured to be mounted in a shallow excavation with the plurality of bollards extending above grade of the excavation; and wherein the at least one first structural member or the at least one structural member or both are configured or tied together to retain within the base supporting media introduced into the base when the base is mounted in the excavation such that the rotation is resisted of a bollard or bollards and the base from an impact against the bollard or bollards.

17. The bollard structure of claim 16, wherein at least one of the opposed ends is formed by a structural member to which an end of the at least one first structural member is secured.

18. The bollard structure of claim 16, wherein the bollard structure is configured to resist impact from a direction of expected impact and the first direction is parallel to the direction of expected impact, and wherein each of the plurality of bollards is secured to at least one structural member that extends in the first direction.

19. The bollard structure of claim 16 wherein the intersecting structural members have axes that extend parallel to a plane of the base.

20. The bollard structure of claim 16 wherein the base has a height of 3 inches to 14 inches.

21. The bollard structure of claim 16, wherein the plurality of structural members comprise one or more tubular members.

22. The bollard structure of claim 21, wherein at least one tubular member comprises a pipe.

23. The bollard structure of claim 21, wherein at least one tubular member comprises a tube.

24. The bollard structure of claim 21, wherein at least one tubular member comprises an angle.

25. The bollard structure of claim 21, wherein at least one tubular member comprises a channel.

26. The bollard structure of claim 16, wherein the plurality of structural members comprises at least one tube.

27. The bollard structure of claim 16, wherein the plurality of structural members comprises at least one pipe.

28. The bollard structure of claim 16, wherein the plurality of structural members comprises at least one angle.

29. The bollard structure of claim 16, wherein the plurality of structural members comprises at least one channel.

30. The bollard structure of claim 16, wherein the plurality of structural members comprises at least one plate.

31. The bollard structure of claim 16, wherein the plurality of structural members comprise structural steel members.

32. The bollard structure of claim 16, comprising a rebar grillage comprising intersecting and tied together rebar members extending coextensively with at least a portion of the base that includes a structural member to which a bollard is secured.

33. A bollard structure comprising:

a plurality of bollards; and a base comprising opposed ends and a plurality of members which intersect and are tied together, for each bollard of the bollard structure at least one first structural member extending from a first of the opposed ends of the base to a second of the opposed ends of the base in a first direction intersecting with the opposed ends, and at least one structural member extending to intersect with the at least one first structural member;

each of the plurality of bollards being secured to at least one of the at least one first structural member and the at least one structural member of the base for the respective bollard and extending upwardly from the base so as to transmit forces applied to the at least one bollard to the base;

at least one of the plurality of members that extend parallel to the ends of the base extending between a structural member to which a first bollard is secured and a structural member to which a second bollard adjacent to the first bollard is secured;

wherein the base is configured to be mounted in a shallow excavation with the plurality of bollards extending above grade of the excavation; and wherein the at least one first structural member or the at least one structural member or both are configured or tied together to retain within the base supporting media introduced into the base when the base is mounted in the excavation such that the rotation is resisted of a bollard or bollards and the base from an impact against the bollard or bollards.

34. The bollard structure according to claim 33, wherein the at least one of the plurality of members that extend between a structural member to which a first bollard is secured and a structural member to which a second bollard adjacent to the first bollard is secured comprises a structural member.

35. The bollard structure according to claim 33, wherein the at least one of the plurality of members that extend between a structural member to which a first bollard is secured and a structural member to which a second bollard adjacent to the first bollard is secured comprises a rebar member.

* * * * *